US008701638B2

(12) United States Patent
Schremmer

(10) Patent No.: US 8,701,638 B2
(45) Date of Patent: Apr. 22, 2014

(54) METHOD FOR IGNITING A FUEL-AIR MIXTURE OF A COMBUSTION CHAMBER, PARTICULARLY IN AN INTERNAL COMBUSTION ENGINE BY GENERATING A CORONA DISCHARGE

(75) Inventor: Torsten Schremmer, Asperg (DE)

(73) Assignee: BorgWarner BERU Systems GmbH, Ludwigshafen (DE)

( * ) Notice: Subject to any disclaimer, the term of this patent is extended or adjusted under 35 U.S.C. 154(b) by 318 days.

(21) Appl. No.: 13/087,660

(22) Filed: Apr. 15, 2011

(65) Prior Publication Data

US 2012/0260898 A1 Oct. 18, 2012

(30) Foreign Application Priority Data

May 7, 2010 (DE) ..... 10 2010 020 469
Jun. 19, 2010 (DE) ..... 10 2010 024 396

(51) Int. Cl.
*F02P 3/01* (2006.01)

(52) U.S. Cl.
USPC ..... 123/606; 123/618; 123/598; 324/522

(58) Field of Classification Search
USPC ..... 315/209 CD; 361/257, 247, 253, 261; 123/143 R, 143 B, 594, 598, 605, 619, 123/620, 621, 623, 636, 169 E, 169 EL, 162, 123/163, 604, 606–608, 626
See application file for complete search history.

(56) References Cited

U.S. PATENT DOCUMENTS

| | | | | |
|---|---|---|---|---|
| 4,317,068 | A * | 2/1982 | Ward et al. | 315/209 CD |
| 6,035,838 | A * | 3/2000 | Tozzi et al. | 123/618 |
| 6,883,507 | B2 * | 4/2005 | Freen | 123/606 |
| 7,038,482 | B1 * | 5/2006 | Bi | 324/762.09 |
| 7,825,666 | B2 * | 11/2010 | Hashimoto | 324/522 |

FOREIGN PATENT DOCUMENTS

| | | | |
|---|---|---|---|
| DE | 100 50 756 | A1 | 8/2002 |
| WO | WO 00/77392 | A1 | 12/2000 |
| WO | WO 2004/063560 | A1 | 7/2004 |
| WO | WO 2010/011838 | A1 | 1/2010 |

* cited by examiner

*Primary Examiner* — Stephen K Cronin
*Assistant Examiner* — Carl Staubach
(74) *Attorney, Agent, or Firm* — Hackler Daghighian & Martino

(57) ABSTRACT

The invention relates to a method for igniting a fuel-air mixture in an internal combustion engine. An electric transformer excites an oscillating circuit connected to a secondary winding of the transformer. A capacitor is formed by an ignition electrode together with the wall of a combustion chamber through which it extends. The excitation of the oscillating circuit is controlled by generating a corona discharge igniting the fuel-air mixture. Before each ignition time the voltage applied to a primary winding of the transformer is incrementally increased, and the intensity of the current flowing in the primary winding is measured repeatedly at the same primary voltage. The variation of the values of the related primary current is determined, and the incremental increase in the primary voltage is aborted at a value thereof at which the variation of the primary current intensity reaches or exceeds a predetermined limit.

13 Claims, 5 Drawing Sheets

METHOD FOR IGNITING A FUEL-AIR MIXTURE OF A COMBUSTION CHAMBER, PARTICULARLY IN AN INTERNAL COMBUSTION ENGINE BY GENERATING A CORONA DISCHARGE

WO 2004/063560 A1 discloses how a fuel-air mixture in a combustion chamber of an internal combustion engine can be ignited by a corona discharge generated in the combustion chamber. For this purpose, an ignition electrode extends in an electrically insulated manner through one of the grounded walls of the combustion chamber and projects into the combustion chamber, preferably opposite of a reciprocating piston provided in the combustion chamber. Together with the grounded walls of the combustion chamber as the counter-electrode, the ignition electrode forms a capacitor. The combustion chamber with the content thereof acts as a dielectric. Depending on the cycle of the piston, it contains air, or a fuel-air mixture, or exhaust gas.

The capacitor forms part of an electric oscillating circuit, which is excited using a high frequency AC voltage that is generated by means of a center-tapped transformer. The transformer cooperates with a control unit, which applies a predeterminable direct current alternately to the two primary coil units of the transformer separated by center tap. The secondary coil unit of the transformer supplies a series oscillating circuit, in which the capacitor formed by the ignition electrode and the walls of the combustion chamber is located. The frequency of the alternating voltage that excites the oscillating circuit and is supplied by the transformer is controlled so that it is as close as possible to the resonant frequency of the oscillating circuit. This creates an excess voltage supply between the ignition electrode and the walls of the combustion chamber in which the ignition electrode is disposed. The resonant frequency typically ranges between 30 kilohertz and 3 megahertz, and the alternating voltage reaches values of 50 kV to 500 kV, for example, at the ignition electrode.

With this, a corona discharge can be generated in the combustion chamber. The corona discharge should not develop into an arc discharge or spark discharge. Care is therefore taken to ensure that the voltage between the ignition electrode and ground remains below the voltage at which complete breakdown takes place. For this purpose, it is known from WO 2004/063560 A1 to measure the voltage and the current at the input of the transformer and, based thereon, calculate the impedance by dividing the voltage by the current. The calculated impedance is compared to a fixed impedance setpoint, which is selected so that the corona discharge can be sustained without resulting in complete dielectric breakdown.

This method has the disadvantage that the formation of the corona is not optimal and in particular does not always reach an optimal size of the corona. This is because the corona increases the closer the oscillating circuit is operated to the breakdown voltage. To prevent that the breakdown voltage is reached under all circumstances, the impedance setpoint, which must not be exceeded, must be so low that voltage breakdown and consequently arc-over are avoided by all means. In establishing the impedance setpoint, it must be taken into consideration that the current-voltage characteristic of the circuit operating the transformer, which hereinafter is also referred to as the igniter, is subject to manufacturing-related fluctuations. If design- or manufacturing engineering-related modifications are made to igniters, which can lead to a change in the current-voltage characteristic, it may be necessary to re-establish the impedance setpoint so as to avoid that a corona that is too small, or in the worst case no corona at all, is formed.

It is known from WO 2010/011838 A1 to control the transformer on the primary side by specifying an impedance setpoint in that first, at low voltage, a baseline impedance is determined at the input of the transformer. Proceeding from low voltage, the voltage-current characteristic at the input of the transformer initially exhibits a linear progression, which indicates constant impedance. At first, the current increases proportionally with the voltage. The baseline impedance is characteristic of the respective igniter. When a certain voltage level is exceeded, the impedance rises, which is indicated by the intensity of the current measured on the primary side of the transformer being no longer proportional to the voltage, but slowly increasing as the increase in the voltage progresses, until a voltage breakdown occurs. In the method known from WO 2010/011838 A1, the impedance setpoint is then established in that it is the sum of the baseline impedance and an additional impedance. The additional impedance is increased in small increments by raising the voltage until a spark discharge occurs. As soon as a spark discharge is detected, the additional impedance is reduced by a slightly larger increment than the preceding increment so as to avoid further spark discharges thereafter and maintain the resonance of the oscillating circuit. In this way, it is possible to maintain the current and voltage at the input of the transformer below the amount at which a spark discharge can occur, which is to say to limit it to an amount at which the corona has reached the maximum size.

The disadvantage with the procedure known from WO 2010/011838 A1 is that it is not possible to ignite the fuel-air mixture by a corona discharge without generating spark discharges from time to time, since the observation of the occurrence of spark discharges is the prerequisite for establishing the impedance setpoint. However, a spark discharge, even if it occurs only sporadically, can also result in less than ideal combustion all the way to spark failures, as well as in consumption of the ignition electrodes.

SUMMARY OF THE INVENTION

The present invention relates to a method for igniting a fuel-air mixture in one or more combustion chambers by means of corona discharge, which allows for optimal formation of the corona and substantially avoids the aforementioned disadvantages to the extent possible.

In the method according to the invention for igniting a fuel-air mixture in a cyclically operating internal combustion engine comprising one or more combustion chambers, which are delimited by grounded walls, an electric oscillating circuit is excited using a igniter comprising an electric transformer, which on the primary side has a baseline impedance $Z_{Baseline}$ that is characteristic of the selected ignition system, the electric oscillating circuit being connected to a secondary winding of the transformer and, in the circuit, an ignition electrode, which extends in an electrically insulated manner through one of the walls delimiting the combustion chamber and projects into the combustion chamber, representing a capacitor in cooperation with the grounded walls of the combustion chamber. The excitation of the oscillating circuit is controlled by generating a corona discharge, which ignites the fuel-air mixture in the combustion chamber at the ignition electrode. For this purpose, before each ignition time of the internal combustion engine, the electric voltage applied to a primary winding of the transformer, which hereinafter is referred to as the primary voltage, is incrementally increased, and the intensity of the electric current flowing in the primary winding as a result of the primary voltage—hereinafter referred to as the primary current—is measured repeatedly at the same primary voltage, the variation of the measured values of the related primary current is determined, and the incremental increase of the primary voltage is aborted at a value at which the related variation of the primary current intensity reaches or exceeds a predetermined limit. The limit can be determined through prior experimentation and should be selected so that the primary voltage comes as close as possible to the breakdown voltage, without reaching it. The breakdown voltage shall be understood to mean the primary voltage above which the corona discharge transitions into a spark discharge or arc discharge. The ignition system comprises the components required for igniting the corona discharge, which are used to carry out the method according to the invention:

The invention has considerable advantages:

By using the method according to the invention, the primary voltage can be brought close to the breakdown voltage and in this way optimal corona discharge can be achieved, without making it necessary to exceed the breakdown voltage from time to time and determine the magnitude thereof.

By incrementally raising the voltage and by determining the resulting increase in the intensity of the primary current, as well as from the variation of the primary current, it is possible to determine the point that is reached on the I–V curve representing the dependence of the primary current on the primary voltage after each incremental step. The characteristic has a typical progression, which is characterized in that the impedance is constant at low primary voltages, which is to say the intensity of the primary current is initially proportional to the primary voltage. The characteristic, which represents the dependence of the primary current on the primary voltage, is a straight line, the gradient of which is the impedance Z=V/I. However, above a certain voltage $U_A$, the impedance increases, the gradient of the I–V curve increases until the breakdown voltage $U_D$ is reached and then drops off. As the primary voltage progressively approaches the breakdown voltage $U_D$, the increase in the primary current continuously decreases, but the variation of the measured values of the primary current intensity progressively increases. The method according to the invention takes advantage of this circumstance by deriving a criterion according to which the increase in the primary voltage can be terminated reliably just before the breakdown voltage $U_D$ is reached.

Given the characteristic progression of the V–I characteristic, the method according to the invention can bring the primary voltage close to the breakdown voltage $U_D$ down to a predetermined distance, even if the absolute amount of the breakdown voltage $U_D$ is unknown. Changes in the impedance, and more particularly in the baseline impedance, which make it necessary in the prior art to determine the breakdown voltage $U_D$ and the impedance present just prior to reaching the breakdown voltage $U_D$ so as to maintain distance from the breakdown voltage $U_D$, do not require any special adjustments when using the method according to the invention. The method according to the invention requires neither a fixed impedance threshold nor a fixed threshold for the primary voltage. The method according to the invention is rather self-adaptive, and it is able to automatically balance changes in the V–I characteristic due to aging processes, manufacturing tolerances, design- or manufacturing engineering-related changes on the igniter, dirt accumulation on the ignition electrode, temperature differences, and due to the use of different control units.

When using the method according to the invention, practically no spark discharges or arc discharges will occur any more during operation of the corona ignition, whereby the consumption of the ignition electrodes is reduced.

The approaching of the breakdown voltage possible according to the invention leads to an optimally large corona, which offers optimal conditions for igniting the fuel-air mixture and ensures rapid propagation of the flame front.

In order to excite the oscillating circuit using a radio frequency alternating current, advantageously a transformer is used, which on the primary side has a center tap at which two primary windings meet. These can alternately be connected in opposite directions to a direct current source, so that the two primary windings are alternately excited in opposite directions, whereby an alternating voltage is induced in the secondary winding of the transformer, the frequency of which is determined by the frequency at which the two primary windings are alternately connected to the direct current source. This frequency is advantageously variable, so that the oscillating circuit on the secondary side of the transformer can be excited with the resonant frequency thereof. It is known to provide, for this purpose, a radio frequency switch on the primary side of the transformer, the switch alternately connecting the two primary windings in opposite directions to the provided direct current source. More details in this respect are disclosed in WO 2004/063560 A1 and WO 2010/011838 A1. The oscillating circuit is advantageously excited discontinuously in a predetermined cycle, which is predetermined by a control unit that is adapted to the method according to the invention.

In an internal combustion engine, the fuel-air mixture must be ignited in each cylinder in each cycle, with the ignition time being predetermined by the engine controller. However, it is also possible to induce more than one ignition process by corona discharge in each cylinder in each engine cycle. This has the advantage that, for example, the fuel is burned more completely by after-burning or exhaust gas having fewer harmful components can be achieved.

Several possibilities exist for the practical implementation of the method according to the invention. The variation of the primary current intensity is advantageously determined from at least 10 consecutive measurements of the primary current intensity at the same primary voltage. The more measurements are taken into consideration for determining the variation of the primary current intensity, the more meaningfully and reliably can the variation of the primary current intensity be determined, and the more closely the breakdown voltage can be approached, without exceeding it. The variation of the primary current intensity is preferably determined from 10 to 150 consecutive measurements of the primary current intensity at the same primary voltage, and more particularly from 50 to 100 measurements. These measurements do not have to be carried out in one and the same engine cycle, but can stem from different engine cycles. It is particularly advantageous to use measurements from several consecutive cycles of the internal combustion engine for determining the variation of the measured values of the primary current intensity, for example performing three measurements of the primary current intensity for each voltage step per engine cycle and to use the measurements from 30 consecutive cycles to determine the variation of the primary current intensity, and to store them for this purpose in a control unit. When measurements from 30 engine cycles are already stored, the measured values from the oldest of, for example, the 30 cycles are deleted, when in a subsequent cycle further measured values are obtained and stored. For this purpose, a memory can be used, which has the design of a shift register. An essential advantage of this procedure is that the time expenditure for determining the variation in each individual engine cycle can be kept low. It has been shown that taking measured values that stem from consecutive engine cycles into consideration leads to very useful results.

In order to approach the breakdown voltage, the primary voltage can be raised in increments of equal size. However, the increments for raising the primary voltage are preferably decreased as the variation progressively approaches the predetermined limit of the variation of the primary current intensity. This makes it easier to select the limit of the variation so that the primary voltage can come particularly close to the breakdown voltage, without reaching it.

The variation can be determined and evaluated in a variety of ways in the method according to the invention. The variation is preferably related to a mean value of the measured values, and more particularly to the arithmetic mean.

It is easiest to determine the spread as a measure of the variation, which is the difference between the highest and lowest measured values. More meaningful values, and values that are better to reproduce, for the variation can be achieved when the mean deviation or the relative mean deviation of the measured values from the mean value thereof is determined as a measure for the variation. The mean deviation is determined by forming the difference between the individual measured values and the mean value of the measured values, and by adding the absolute amounts of the differences—which is to say without consideration of the algebraic signs of the individual differences—and to divide the sum obtained in this way by the number of measurements. The mean deviation then has the same dimension as the measured value; the mean deviation of the power current intensity is thus the dimension of a current intensity.

Instead of the (absolute) mean deviation, the relative mean deviation can be used to establish a limit. The relative mean deviation is obtained by relating the mean deviation to the mean value of the measured values. The relative mean deviation is therefore non-dimensional and can be specified in percent, for example.

The solution according to independent claim 4 differs from the solution according to claim 1 only in that the primary current intensity flowing in the primary winding of the transformer is raised in predetermined increments, and the voltage that is released at the primary winding at the respective primary current intensity is measured, and the variations are measured for a plurality of primary voltages measured at the same primary current intensity and are compared to a predetermined limit. In this case, the primary current intensity is not increased further when the variation of the values of the primary voltage that occurs at this primary current intensity reaches or exceeds the predetermined limit. In this case, the spread, the mean deviation from the mean value of the variation, or the relative mean deviation from the mean value of the primary voltage can all be used as a measure of the variation.

Of the two possibilities of evaluating either the variation of the primary current intensity or the variation of the primary voltage, the evaluation of the primary current intensity is preferred.

Regardless of whether this is to be determined as a spread or as a mean variation, the threshold of the variation can be determined for a certain engine, and for a corona ignition device provided therefor, by prior experimentation and can then be used for the entire series of engines of identical design in the method according to the invention.

In a reciprocating engine, the breakdown voltage $U_D$ depends on the distance between the ignition electrode and the piston or—in order words—on the position of the crankshaft or—in other words—on the advance angle. Because the ignition of the fuel-air mixture is to take place at a certain piston position, or at a certain advance angle, which can be varied by the engine controller, it is advantageous to establish different limits of the variation for different piston positions or advance angles, and to store the established values of the limit of the variation depending on one of the three parameters of "piston position", "position of the crankshaft" or "advance angle" in a control unit, for example in an engine controller that is already present or in an ignition control unit that is provided separately for controlling the ignition method according to the invention, and to use them depending on the selected parameter, so as to limit the rise in the primary voltage to a value just below the breakdown voltage $U_D$ or to limit the rise in the primary current to a value below the breakdown current $I_D$. The breakdown current $I_D$ is considered to be the maximum of the primary current intensity that develops before the voltage breakdown occurs. As long as the value of the selected parameter remains constant, the limit of the variation should also remain constant.

BRIEF DESCRIPTION OF THE DRAWINGS

The invention will be explained in more detail hereinafter based on the enclosed schematic drawings.

DETAILED DESCRIPTION

Figure 1:
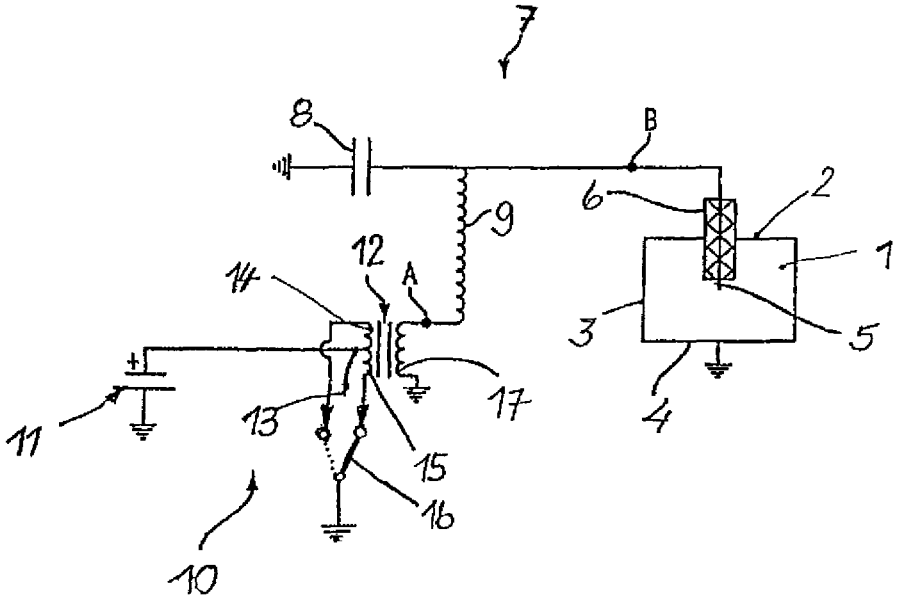
FIG. 1 shows the schematic design of an ignition system for a vehicle motor.

FIG. 1 shows a combustion chamber 1, which is delimited by grounded walls 2, 3 and 4. From above, an ignition electrode 5 projects into the combustion chamber 1, the electrode being surrounded over part of the length thereof by an insulator 6, by which it is guided in an electrically insulated manner through the upper wall 2 into the combustion chamber 1. The ignition electrode 5 and the walls 2 to 4 of the combustion chamber 1 form part of a series oscillating circuit 7, which also comprises a capacitor 8 and an inductor 9. The series oscillating circuit 7 can, of course, comprise further inductors and/or capacitors and other elements, which a person skilled in the art will be familiar with as possible components of series oscillating circuits.

A high frequency generator 10 is provided for exciting the oscillating circuit 7, the generator having a direct current source 11 and a transformer 12 with a center tap 13 on the primary side, with two primary windings 14 and 15 meeting at the center tap 13. By means of a radio frequency switch 16, the ends of the primary windings 14 and 15 located away from the center tap 13 are alternately connected to ground. The switching frequency of the radio frequency switch 16 determines the frequency with which the series oscillating circuit 7 is excited and it can be varied. The secondary winding 17 of the transformer 12 supplies the series oscillating circuit 7 at point A. Using a control circuit, which is not shown, the radio frequency switch 16 is controlled so that the oscillating circuit is excited with the resonant frequency thereof. The voltage is then the largest between the tip of the ignition electrode 5 and the grounded walls 2 to 4.

Figure 2:
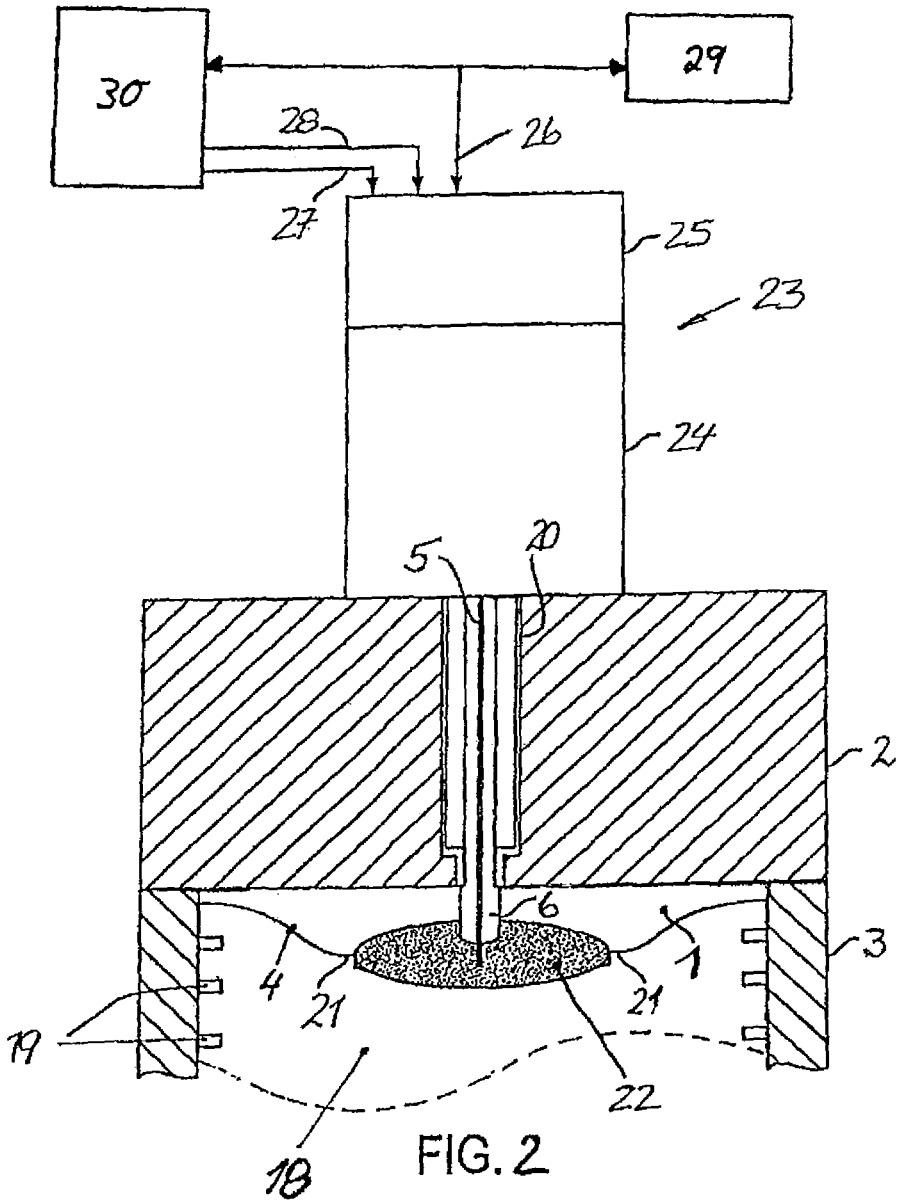
FIG. 2 shows a longitudinal section of a cylinder of an internal combustion engine, which is linked to the ignition system shown in FIG. 1.

FIG. 2 shows a longitudinal section of a cylinder of an internal combustion engine, which is equipped with the ignition device shown schematically in FIG. 1. The combustion chamber 1 is delimited by an upper wall 2 designed as a cylinder head, by a cylindrical peripheral wall 3, and by the surface 4 of a piston 18 that can move back and forth in the cylinder, the piston being provided with piston rings 19.

In the cylinder head 2, a passage 20 is provided, through which the ignition electrode 5 extends in an electrically insulated and sealed manner. Over part of the length, the ignition electrode 5 is surrounded by an insulator 6, which may be composed of sintered ceramic material, for example aluminum oxide ceramics. The ignition electrode 5 projects with the tip thereof into the combustion chamber 1 and protrudes slightly over the insulator 6, but could also end flush therewith.

In the surroundings of the tip of the ignition electrode 5, several sharp-edged protrusions 21 can be provided on the surface of the piston 18, which are used to locally increase the electric field strength between the ignition electrode 5 and the piston 8 located opposite thereof. A corona discharge, which can be accompanied by a generally intensive charge carrier cloud 22, forms notably in the region between the ignition electrode 5 and the selectively present protrusions 21 of the piston 18 during excitation of the oscillating circuit 7.

A housing 23 is attached to the outside of the cylinder head 2. A first segment 24 of the housing 23 accommodates the primary windings 14 and 15 of the transformer 12 and the high frequency switch 16 cooperating therewith. A second segment 25 of the housing 23 accommodates the secondary winding 17 of the transformer 12 and the remaining components of the series oscillating circuit 7, as well as optionally means for observing the behavior of the oscillating circuit 7. A connection can be established, for example, to a diagnostic device 29 and/or to an engine control unit 30 by way of an interface 26.

Figure 3:
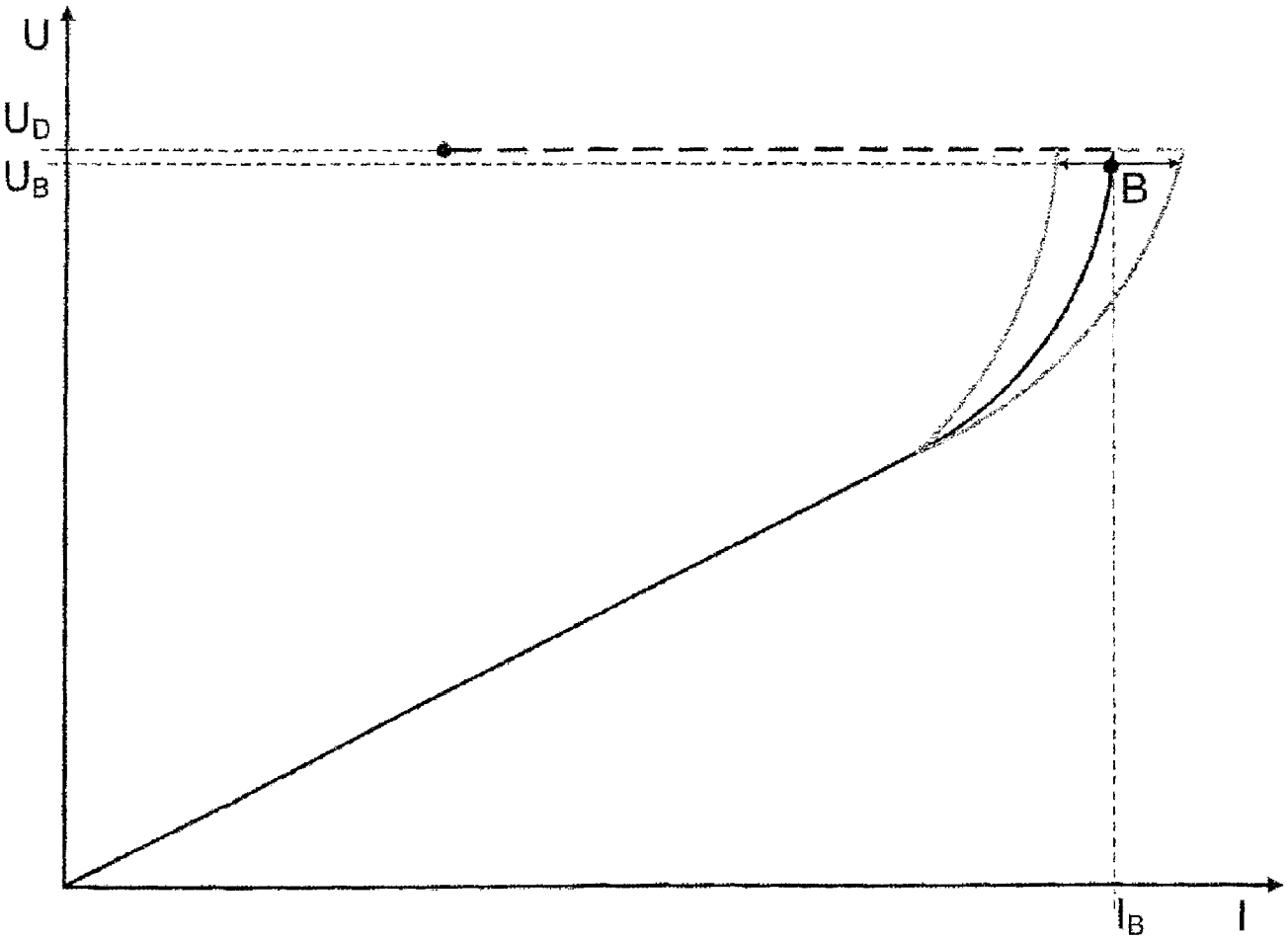
FIG. 3 shows the V–I characteristic at the input of the transformer and serves to illustrate the approaching of the breakdown voltage by evaluating the variation of the measured primary current intensity.

FIG. 3 shows a V–I characteristic at the input of the transformer 12 for locating and reaching an end value $U_B$ of the primary voltage, which is just below the breakdown voltage $U_D$.

To reach this end value $U_B$, the primary voltage is raised incrementally. In the nonlinear part of the V–I characteristic, as the increase in the primary voltage progresses, the spread increases or the mean variation of the primary current intensity measured at the individual voltage steps. The increasing spread or the increasing mean variation of the primary current intensity is shown in idealized form in FIG. 3. When the spread or the mean deviation of the primary current intensity from the mean value thereof exceeds a predetermined limit at a certain primary voltage, the limit being shown in FIG. 3 at the level of point B on the V–I characteristic of the ignition device by a double arrow, the primary voltage is not raised further, but is limited to the value $U_B$.

The limit of the variation is established by prior experimentation such that it is reached at a primary voltage $U_B$, which is just below the breakdown voltage $U_D$, and the corona reaches the optimal size.

The limit of the variation can be determined through prior experimentation depending on the distance of the tip of the ignition electrode from the piston, or depending on the position of the crankshaft, or depending on the advance angle. Depending on one of these parameters, the limits of the variation are stored in a control unit and can be used by the same for the purpose of managing the engine. The values can be stored in an engine control unit that is already present, however preferably they are stored in a separate ignition control unit.

Figure 4:
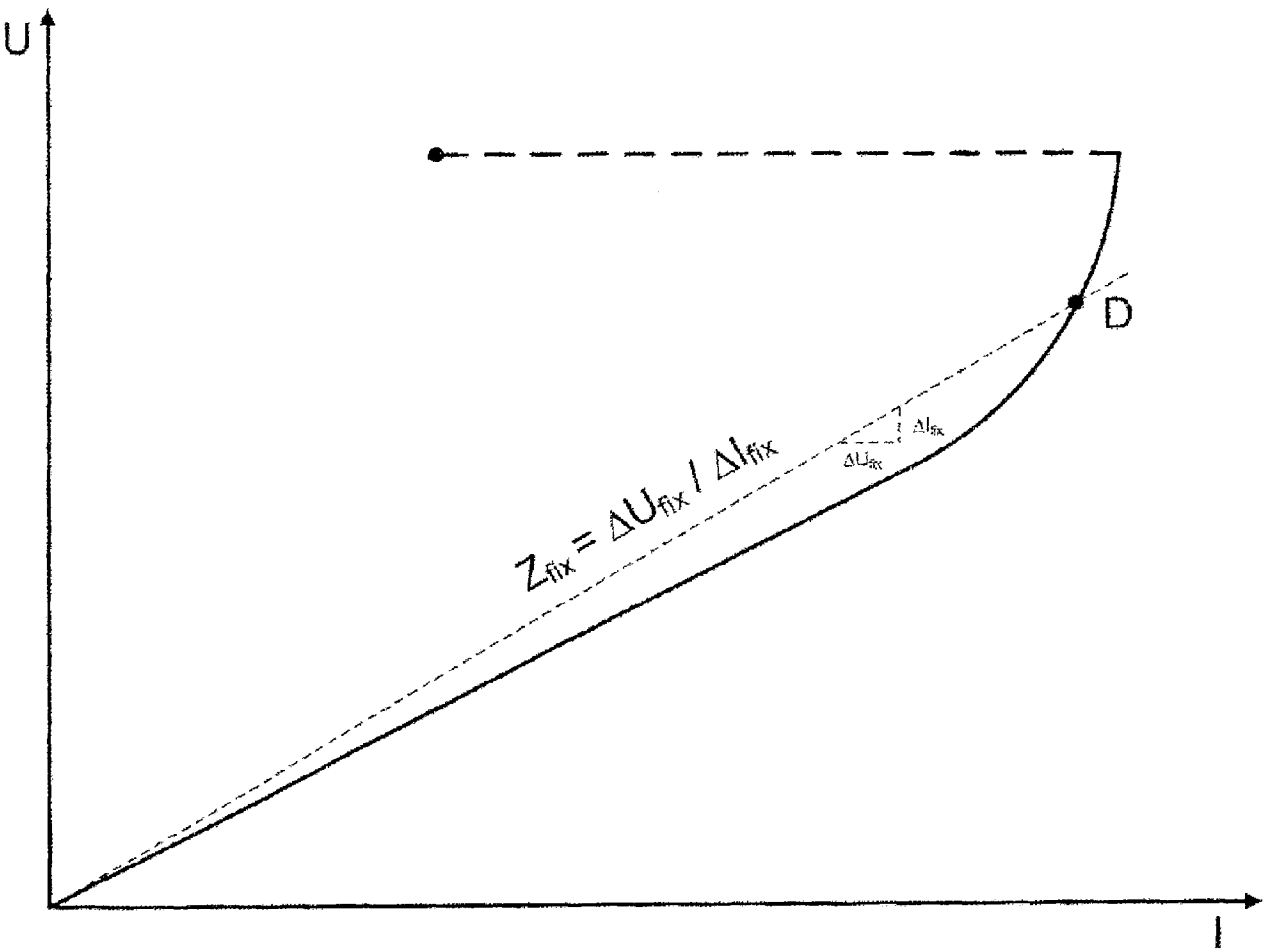
FIG. 4 shows a V–I characteristic at the input of the transformer 12 having a fixed impedance threshold as the setpoint for control purposes according to the method disclosed in WO 2004/063560 A1, which is the prior art.

Following the method according to the invention avoids the breakdown voltage $U_D$ from being reached and exceeded during operation of the engine, contrary to the methods from the prior art. In the method known from WO 2004/063560 A1, as soon as the measured impedance exceeds a fixed threshold, the primary voltage $Z_{fix}$ is not raised further, so as to safely prevent spark discharge. The impedance threshold $Z_{fix}$ must ensure a corona without arc-over for a variety of igniters. Since this must also apply to igniters in which the course of the V–I characteristic is different due to design- or manufacturing engineering-related changes, $Z_{fix}$ must be selected relatively low. For this reason, the straight line, which represents the value $Z_{fix}$, intersects the V–I characteristic at a point D far below the breakdown voltage $U_D$, see FIG. 4. The corona can therefore not reach the maximum size in most cases.

Figure 5:
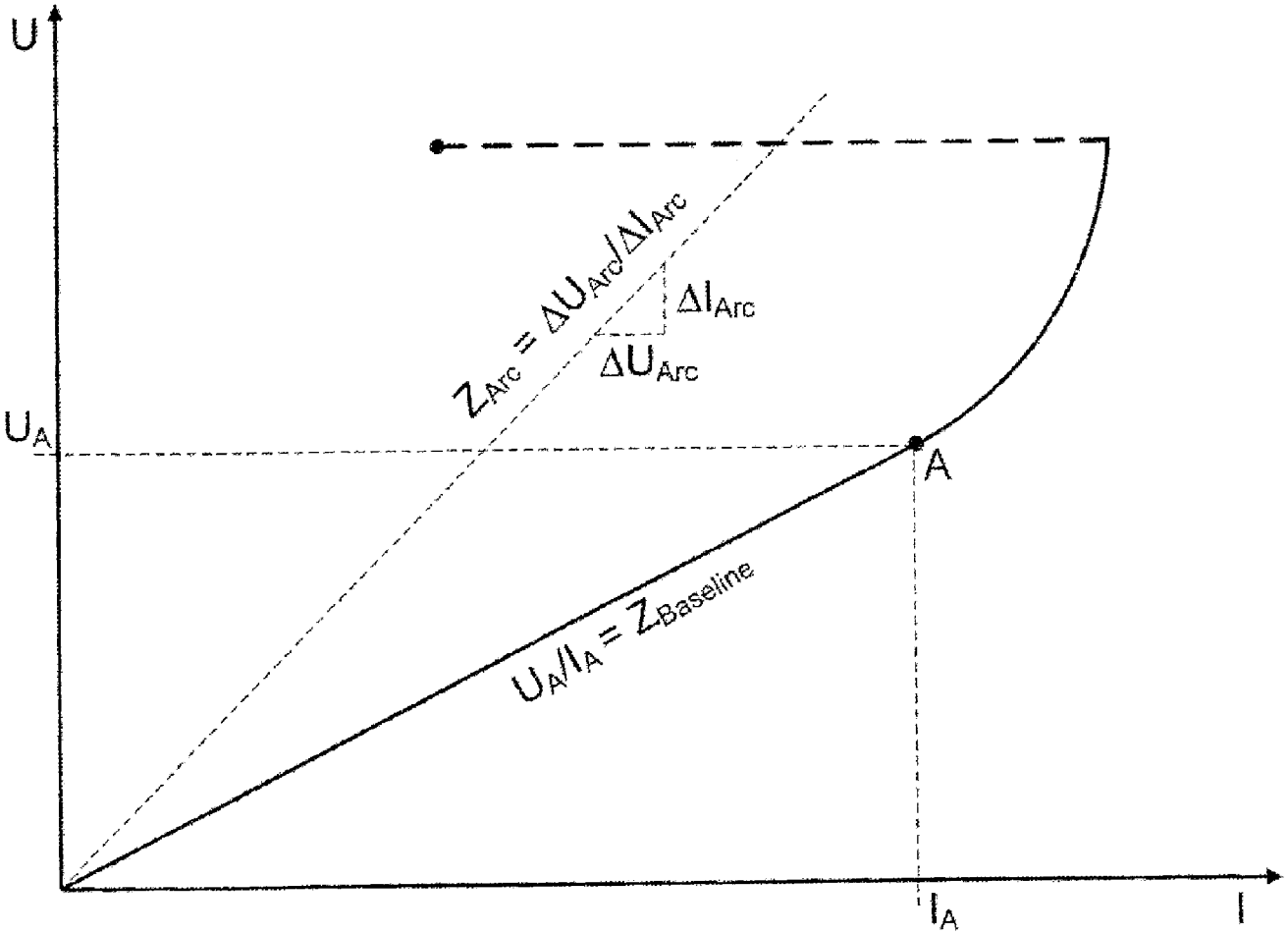
FIG. 5 shows a V–I characteristic at the input of the transformer 12 having a fixed impedance threshold for detecting a spark discharge according to a method known from WO 2010/011838 A1.

According to the method disclosed in WO 2010/011838 A1, first the baseline impedance in the linear portion of the characteristic curve is determined. Then, the impedance is raised incrementally until a spark discharge was detected. A spark discharge is detected by the measured impedance exceeding a threshold value $Z_{Arc}$, see FIG. 5. After detecting a spark discharge, the impedance is reduced by a larger increment, so that in the following engine cycles again a corona can develop without spark discharge. The present invention, however, avoids the necessity to generate a spark discharge so as to achieve a corona discharge without spark discharge in subsequent ignitions.

LIST OF REFERENCE NUMERALS

1. Combustion chamber
2. Wall of the combustion chamber
3. Wall of the combustion chamber
4. Wall of the combustion chamber, surface of piston 18
5. Ignition electrode
6. Insulator
7. Oscillating circuit, series oscillating circuit
8. Capacitor
9. Inductor
10. Radio frequency generator
11. Direct current source
12. Transformer
13. Center tap
14. Primary winding
15. Primary winding
16. Radio frequency switch
17. Secondary winding
18. Piston
19. Piston rings
20. Passage
21. Protrusions
22. Charge carrier cloud
23. Housing
24. First segment of 23

25. Second segment of 23
26. Interface
27. Input
28. Input
29. Diagnostic device
30. Engine control unit

What is claimed is:

1. A method for igniting a fuel-air mixture in a cyclically operating internal combustion engine comprising one or more combustion chambers, which are delimited by grounded walls, wherein an electric transformer is used to excite an electric oscillating circuit, which is connected to a secondary winding of the transformer and in which a capacitor is formed by an ignition electrode, which extends in an electrically insulated manner through one of the walls delimiting the combustion chamber, together with the grounded walls of the combustion chamber, and wherein the excitation of the oscillating circuit being controlled to generate a corona discharge that ignites the fuel-air mixture in the combustion chamber at the ignition electrode, wherein before each ignition time of the internal combustion engine, the electric voltage applied to a primary winding of the transformer—hereinafter referred to as the primary voltage—is incrementally increased, and the intensity of the electric current flowing in the primary winding as a result of the primary voltage—hereinafter referred to as the primary current—is measured repeatedly at the same primary voltage, the variation of the measured values of the related primary current is determined, and the incremental increase in the primary voltage is aborted at a value of the primary voltage at which the related variation of the primary current intensity reaches or exceeds a predetermined limit.

2. The method according to claim 1, wherein the variation of the primary current intensity is determined from at least 10 measurements of the primary current intensity at the same primary voltage.

3. The method according to claim 1, wherein the variation of the primary current intensity is determined from 10 to 150 measurements of the primary current intensity at the same primary voltage.

4. A method according to claim 1, wherein the increments for raising the primary voltage or the primary current intensity are reduced as the variation progressively approaches the predetermined limit of the variation.

5. A method according to claim 1, wherein the variation is based on a mean value of the measured values.

6. A method according to claim 1, wherein a spread is determined as a measure for the variation, wherein the spread comprises the difference between the highest and lowest measured values.

7. A method according to claim 1, wherein a mean deviation or a relative mean deviation of the measured values from a mean value thereof is determined as a measure for the variation.

8. A method according to claim 1, wherein the limit of the variation is determined beforehand by experimentation using an ignition device for carrying out the method according to claim 1, and is then used for ignition devices of the same type.

9. The method according to claim 8, wherein the experiments are carried out using an engine and the limit or limits determined for this engine is or are then used for a series of engines of identical design.

10. The method according to claim 8, wherein the limit of the variation is determined for a reciprocating engine depending on the distance of the piston from the tip of the ignition electrode, or depending on the position of a crankshaft, or depending on the advance angle, is stored and used for ignition devices of the same type and engines of identical design depending on the value of one of these three parameters, with the limit only changing with the value of the selected parameter.

11. A method according to claim 1, wherein measurements from several consecutive cycles of the internal combustion engine are used to determine the variation.

12. The method according to claim 1, wherein the variation of the primary current intensity is determined from 50 to 100 measurements of the primary current intensity at the same primary voltage.

13. A method for igniting a fuel-air mixture in a cyclically operating internal combustion engine, comprising:

providing one or more combustion chambers, which are delimited by grounded walls, wherein an electric transformer is used to excite an electric oscillating circuit, which is connected to a secondary winding of the transformer and in which a capacitor is formed by an ignition electrode, which extends in an electrically insulated manner through one of the walls delimiting the combustion chamber, together with the grounded walls of the combustion chamber;

controlling the excitation of the oscillating circuit to generate a corona discharge that ignites the fuel-air mixture in the combustion chamber at the ignition electrode;

increasing incrementally an electric voltage applied to a primary winding of the transformer before each ignition time of the internal combustion engine;

measuring several times after each incremental increase of the electric voltage an intensity of an electric current flowing in the primary winding;

calculating a change of the intensity of the electric current flowing in the primary winding in response to a value of the electric voltage achieved as a result of an incremental increase and applied to the primary winding of the transformer;

comparing the change with a predetermined limit;

stopping the incremental increase of the electric voltage when the change reaches or exceeds the predetermined limit; and exciting the oscillating circuit by applying a value of an electric voltage that was reached when the incremental increase was stopped to the primary winding of the transformer.

* * * * *